US006732397B2

(12) United States Patent
Thompson

(10) Patent No.: US 6,732,397 B2
(45) Date of Patent: May 11, 2004

(54) GOLF SHOE BRUSH

(76) Inventor: Dean Jeffery Thompson, 222 N. Rose St., #104, Burbank, CA (US) 91505

( * ) Notice: Subject to any disclaimer, the term of this patent is extended or adjusted under 35 U.S.C. 154(b) by 21 days.

(21) Appl. No.: 10/146,261

(22) Filed: May 13, 2002

(65) Prior Publication Data

US 2003/0208868 A1 Nov. 13, 2003

(51) Int. Cl.[7] ..... A43B 5/00

(52) U.S. Cl. ..... 15/160; 15/227; 36/132; 36/136

(58) Field of Search ..... 15/160, 210.1, 15/227; 36/134, 136, 132

(56) References Cited

U.S. PATENT DOCUMENTS

| | | | |
|---|---|---|---|
| 1,515,665 A | | 11/1924 | Eck |
| 3,218,734 A | | 11/1965 | O'Brien |
| 4,122,577 A | | 10/1978 | Catania |
| 4,407,079 A | | 10/1983 | Chiroff |
| 5,433,436 A | | 7/1995 | Hoyt et al. |
| 5,809,669 A | | 9/1998 | Hage et al. |
| 5,930,920 A | | 8/1999 | Arnold |
| 5,979,008 A | | 11/1999 | Gordon |
| 6,009,640 A | | 1/2000 | Deacon et al. |
| 6,393,648 B1 | * | 5/2002 | Reynolds |
| 2003/0131500 A1 | * | 7/2003 | Kline et al. |

OTHER PUBLICATIONS

International Search Report Dated Sep. 18, 2003.

* cited by examiner

*Primary Examiner*—Randall Chin
(74) *Attorney, Agent, or Firm*—Stephen M. Nipper; Frank J. Dykas; Robert L. Shaver

(57) ABSTRACT

An attachment for fastening a brush to a shoe. The attachment having a first (horizontal) flange extending to a second (vertical) flange. The first flange attaching to the sole of the shoe, with the second flange attaching to a wiping element such as a brush. The attachment could alternatively be provided with a disk-like single flange having threading allowing the attachment to be screwed into a standard golf shoe threaded spike hole.

11 Claims, 5 Drawing Sheets

GOLF SHOE BRUSH

BACKGROUND OF THE INVENTION

1. Field of the Invention

The present invention generally relates to sporting goods, and more particularly relates to athletic shoes and attachments for athletic shoes.

2. Background Information

In the sport of golfing, a club is used to strike a ball lying upon or slightly elevated above a ground surface. Through this process, frequently the head of the golf club will become soiled with pieces of vegetation, soil, and other pieces of detritus when the club engages the ball at or near the surface of the ground. This club head soiling is accentuated when the golf club is utilized on a driving range and dozens to hundreds of ball strikes occur within a short period of time. This club head soiling effects the use and accuracy of the club and must regularly be removed.

Golfers have utilized many different means for cleaning soil, grass clippings, sand and dew from golf heads. For instance, it is known to carry a "golf towel." The golf towel is merely a cloth towel, often able to be directly attached to the golfer's golf bag, which is used to wipe down the golf club's face and any other soiled surface. However, golf towels are not very abrasive and thus have a difficult time removing ground in dirt. Such towels are also frequently soiled to the point where they need to be washed, and they are typically, as mentioned, connected to the golf bag which often at times is not in close proximity to the golfer.

Another device utilized by golfers for removing of soil and other materials from the golf club face is a handheld golf brush. Such a handheld brush has a handle having extending from it a number of bristles, typically of a stiff synthetic material or metal. Such a brush is typically connected to the golf bag, which is not always near to the golfer. Utilization of a golf brush is awkward in that the user often needs to hold the club in one hand and the brush in the other hand while scrubbing the clubface. A golf brush typically is useless for removing dew or grass from the golf club head.

A third type of device is a small housing containing two brushes of varying materials that are enclosed in a housing and can typically be carried in the pocket of a golfer. One brush at a time can be used by pushing up through an opening in either end of the housing. The disadvantage to this product is that it can be difficult to use for those with poor hand strength, and requires a certain level of dexterity to operate. Furthermore, any material removed from the face of the golf club is likely to end up back in the golfer's pocket.

What is needed is a device for use in cleaning soiled golf club faces, which is an improvement over the prior art in that it is abrasive enough to remove soil which has become encrusted upon the club head face, which is never located in a position distant from the golfer thereby making the golfer have easy and convenient access to the device, which is easy and non-awkward to use, and which does not clutter or dirty the clothing of the user. The present invention solves these needs.

SUMMARY OF THE INVENTION

The present invention is an attachment for fastening a brush to a shoe. In the preferred embodiments, this the shoe is a golf shoe and the brush is used to clean golf club heads.

In one embodiment the golf shoe wiping attachment is adapted to be attached to a golfer's shoe for cleaning golf club heads. Such a golfer's shoe will have a side wall. The attachment itself comprises a generally L-shaped bracket having a first flange generally perpendicular to a second flange. The first flange being formed with at least one orifice defined therein able to receive and to be frictionally held by a single spike projecting from the underside of the golfer's shoe. The second flange having an inner side opposite an outer side. The inner side facing and generally perpendicular to the golfer's shoe side wall when the first flange is frictionally held by the spike. The attachment further comprises a wiping element for wiping, contacting or scrubbing a surface. Furthermore, the attachment comprises a connection for securing the wiping element to the second flange, this wiping element extending from the golfer's shoe generally perpendicular to and away from the outer side of the second flange. This wiping element being operative to clean a golf club head by a sweeping movement of said golf club head against the same. It is preferred that the wiping element is a brush. It is preferred that this attachment embodiment also comprise a plurality of overlapping orifices thereby allowing said attachment second flange to be spaced a desired distance from said golf shoe side wall. It is also preferred that the connection for securing be releasable, thereby allowing the wiping element to be detached from the second flange.

In a second embodiment, the golf shoe brush attachment is adapted to be attached to a golfer's shoe for cleaning golf club heads. The attachment comprises a disk-like flange having an upper surface, this disk-like flange for placement underneath and in contact with the sole of the golfer's shoe. This disk-like flange also having an opposing bottom surface. The attachment further comprises a plurality of bristles, these bristles extending down from the bottom surface for the flange. These bristles for cleaning golf club heads. The attachment further comprises an fastener extending from the upper surface. This fastener for removably attaching the attachment to the golfer's shoe. It is preferred that the fastener comprise a threaded stud extending axially up from the upper surface, this stud for screwing into the bottom of the golfer's shoe, preferably into a threaded hole provided therein.

In yet another embodiment, the present invention comprises a removable athletic shoe attachment for use with an athletic shoe having a sole. This attachment comprising a disk-like flange for fitting in a snug and gripping manner against the shoe sole; a plurality of bristles extending down from the bottom surface of the flange for supplying brushing surface for brushing an object; and a threaded stud integrally formed with and extending up from the center of the upper surface of the flange for removably attaching the attachment to the athletic shoe.

Still other objects and advantages of the present invention will become readily apparent to those skilled in this art from the following detailed description wherein I have shown described only the preferred embodiment of the invention, simply by way of illustration of the best mode contemplated by carrying out my invention. As will be realized, the invention is capable of modification in various obvious respects all without departing from invention. Accordingly, the drawings and description of the preferred embodiment are to be regarded as illustrative in nature, and not as restrictive.

DESCRIPTION OF THE PREFERRED EMBODIMENTS

Figure 1:
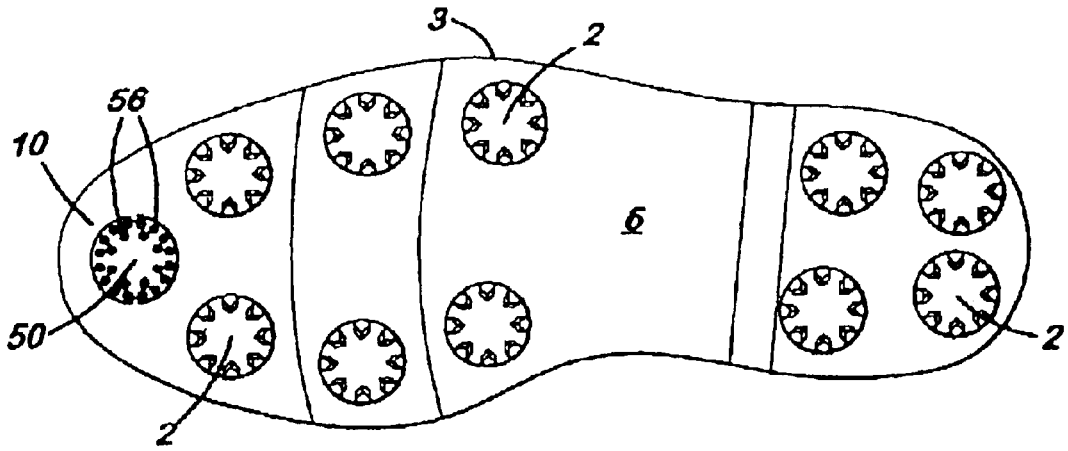
FIG. 1 is an environmental view of a first embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is an attachment for fastening a wiping element to a shoe. Any type shoe can be used, as can any wiping element. In the preferred embodiments, the present invention is an improved golf shoe brush attachment adapted to be attached to a golfer's shoe for use in the cleaning of golf club heads and other items, such as golf cleats.

Figure 2:
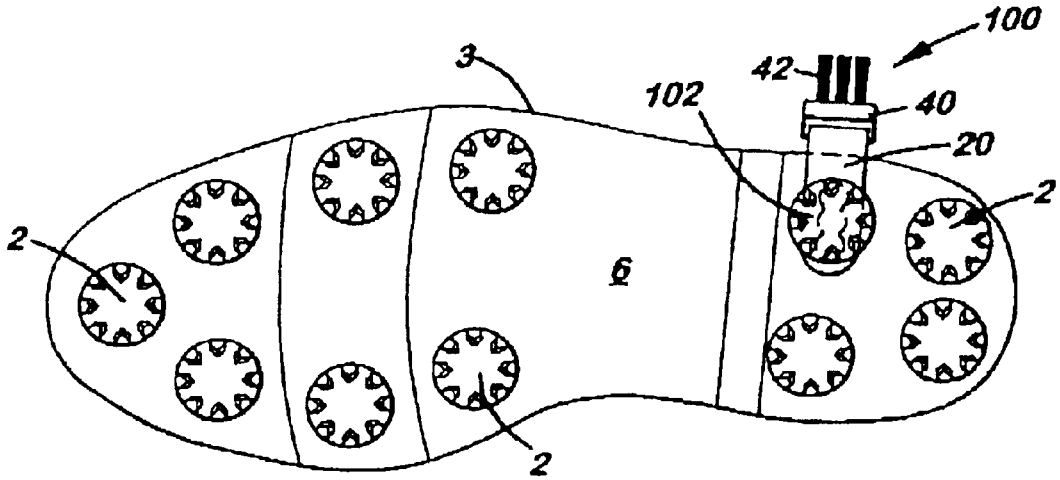
FIG. 2 is an environmental view of a second embodiment of the present invention.
Figure 3:
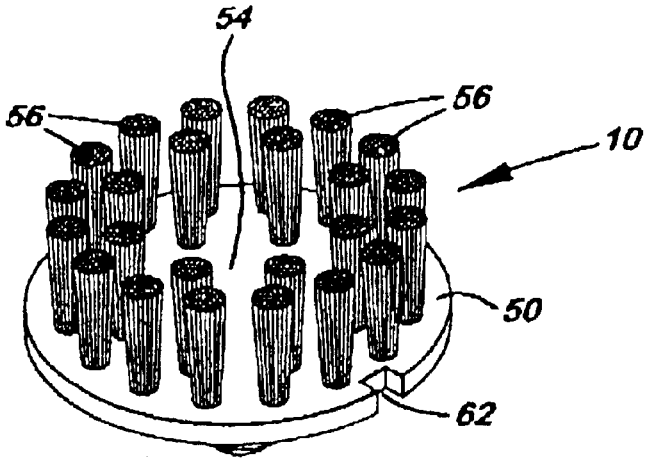
FIG. 3 is a perspective view of a third embodiment of the present invention.
Figure 4:
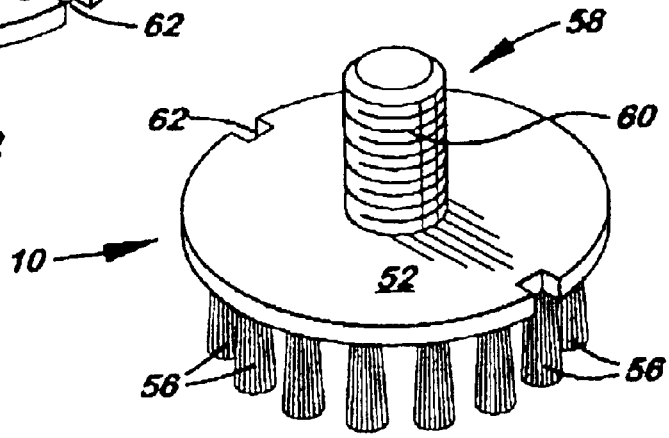
FIG. 4 is a reverse perspective view of the embodiment of FIG. 3.
Figure 5:
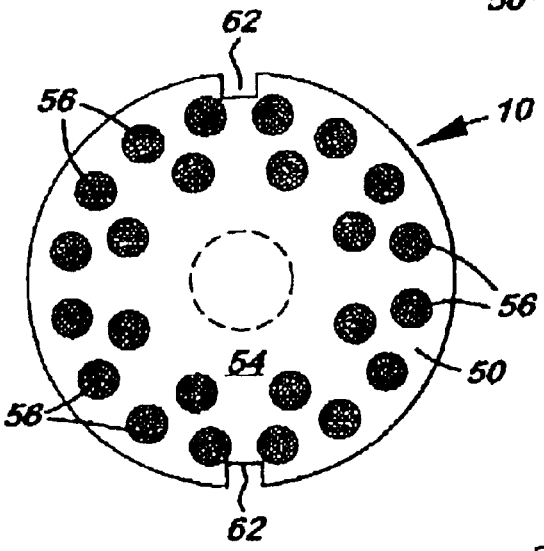
FIG. 5 is a top view of the embodiment of FIG. 3.
Figure 6:
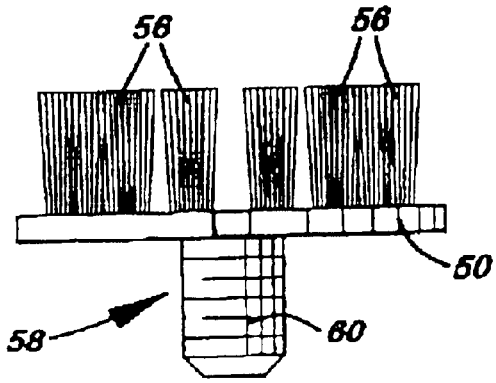
FIG. 6 is a side view of the embodiment of FIG. 3.

Referring now to FIGS. 1 and 2, shown are the two main embodiments of the present invention. FIG. 1 shows the golf shoe toe brush embodiment of the present invention. This embodiment is shown used upon a golf shoe 3 having a number of cleats 2 and a sole 6. The golf shoe brush attachment 10 comprises a disc-like flange 50 attaching to the sole 6 of the shoe 3 through use of a fastener, such as the threading used by a standard golf shoe spike. The disc like flange 50 having a number of bristles 56 extending therefrom. The preferred placement of the golf shoe brush attachment 10 would be the as a replacement of the toe cleat, as shown.

Referring now to FIG. 2, the other main embodiment of the golf shoe brush attachment 100 utilizes a first flange 20 extending to a second flange (not shown) to which a wiping element 40 attaches. The first flange 20 having at least one orifice defined therethrough for receiving the stud of a golf spike 102. The golf shoe brush attachment 100 is able to be attached to the golf shoe 3 through first unscrewing an existing golf shoe spike 102, aligning the orifice of the first flange 20 with the spike's 102 threaded orifice located in the shoe's sole 6 and then inserting the spike stud of the spike 102 through the orifice and into the threaded hole located within the sole 6 of the golf shoe 3. Removal of such an embodiment is just as easy—it is removed by unscrewing and removing the spike 102 retaining the golf shoe brush attachment 100, removing the golf shoe brush attachment 100, and replacing the golf spike 102.

Preferably, the golf shoe brush attachment 100 is located at the foremost outside golf shoe heel spike location, as shown. However, placement of the golf shoe brush attachment 100 could be made at any golf shoe spike location, with the outside spikes obviously being more preferred than the inside spikes.

Referring now to FIGS. 3 through 6, shown is the preferred embodiment of the golf shoe brush cleat attachment 10 embodiment of the present invention. This embodiment comprises a disc-like flange 50, preferable similar in size and structure as a typical golf shoe spike disc-like flange. This disc like flange 50 having an upper surface 52 opposite a bottom surface 54. Extending from the upper surface 52 is a fastener 58, such as the threaded stud 60 shown. This threaded stud 60 being of the same threading as a usual golf shoe spike thereby enabling said stud to be easily screwed into an existing threaded spike orifice located in a golf shoe's sole. The length, diameter and threading of the threaded stud 60 may be varied to accommodate many different makes, models and styles of golf shoes. The disc-like flange and the fastener can be composed of any suitable material, but will be composed most preferably of a plastic.

Extending from the bottom surface 54 are a plurality of bristles 56. It is preferred that these bristles be generally perpendicular to the bottom surface, however angular mounts are also possible. The preferred bristle matter of composition is nylon, however other bristle compositions are also possible, including, but not limited to animal hair, plastics, composites and metals. Any number of bristles or clusters of bristles may be utilized with the present invention, for instance the entire bottom surface 54 may be covered with bristles. The type, length, orientation, manufacture and style of the bristles used on one attachment can be varied as well.

Preferably at least one fastening notch 62 (ideally an opposing pair as shown) are provided for allowing a user to utilize a key or other device to assist in the screwing or unscrewing of the threaded stud 60 into a threaded golf shoe spike hole located within a golf shoe sole.

Figure 7:
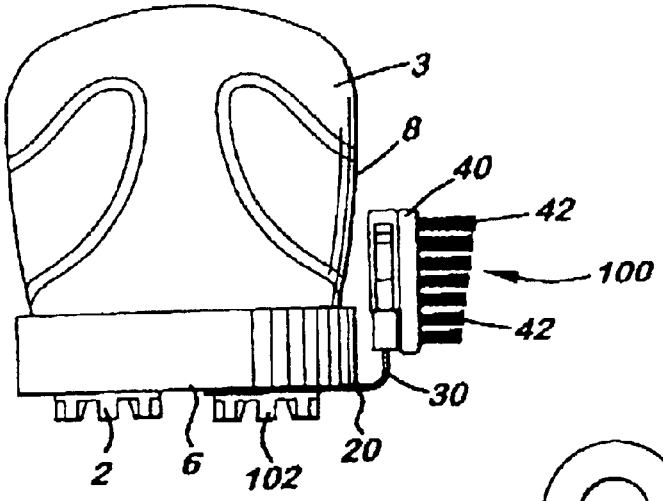
FIG. 7 is an environmental view of a fourth embodiment of the present invention.
Figure 8:
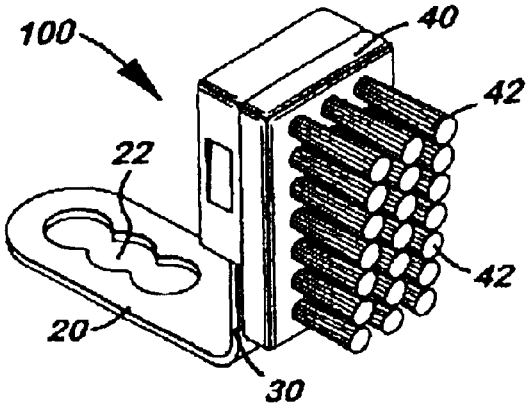
FIG. 8 is a perspective view of the embodiment shown in FIG. 7.
Figure 9:
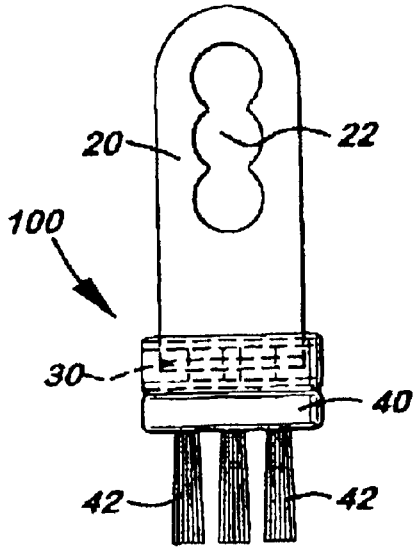
FIG. 9 is a top view of the embodiment shown in FIG. 7.
Figure 10:
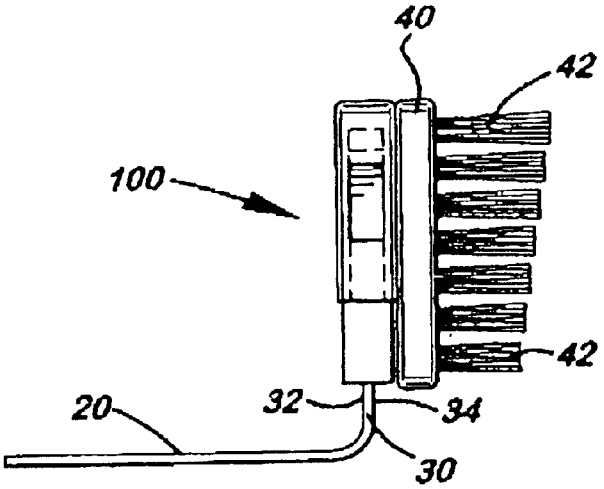
FIG. 10 is a side view of the embodiment shown in FIG. 7.
Figure 11:
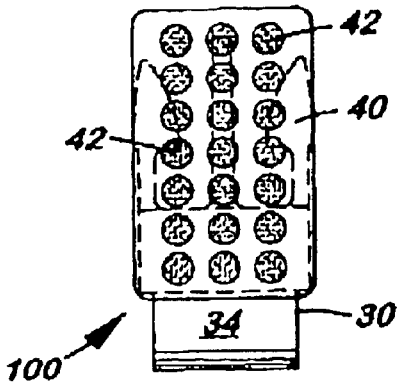
FIG. 11 is an end view of the embodiment view shown in FIG. 7.

Referring now to FIGS. 7 though 11, shown is one embodiment of the golf shoe brush side attachment 100 embodiment of the present invention. In this embodiment, the golf shoe brush attachment 100 attaches to a golf shoe 3 through the attachment's first flange 20 being held against the heel/sole 6 of the shoe 3 by a spike 102. This embodiment of the golf shoe brush attachment 100 comprises a first flange 20 extending to a second flange 30. It is preferred that the first flange 20 be generally perpendicular to the second flange 30.

The first flange 20 having at least one orifice 22 able to receive therethrough the spike stud of a golf shoe spike. In such a manner, the present invention can be attached to the sole of a golf shoe. In this embodiment, the second flange 30 has an inner side 32 and an outer side 34. This inner side 32 generally facing the shoe side wall 8, whereas in use the outer side 34 generally faces away from said shoe side wall 8. Attaching to the second flange 30 is the wiping element 40.

It is preferred that such an attachment be releasable so that the wiping element 40 can be attached and detached to the second flange 30. For instance, the embodiment shown in FIGS. 7 through 11 so the use of a squeeze clip buckle style attachment, whereby attaching to the second flange 30 is the male portion of the buckle, and formed within the wiping element 40 is the female portion of the buckle. Other releasable attachments include but are not limited to: hook-and-loop style attachments, magnets, snaps, adhesives, groves, dove tails, etc. In being detachable, the present invention can be selectively removed from the golfer's shoe, a benefit to the golfer should the golfer prefer not to have the attachment 100 attached and/or visible when the golfer is not on the course or at the driving range. While releasable attachment is preferred it is also understood that the wiping element could be fixedly attached to the second flange.

Figure 17:
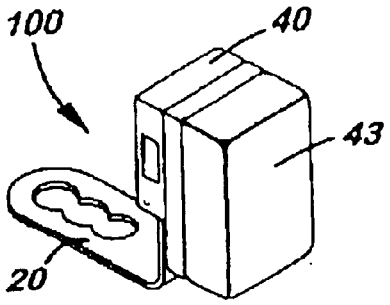
FIG. 17 is a perspective view of an eighth embodiment of the present invention.

In this embodiment, extending from the wiping attachment 40, preferably generally perpendicular to the second flange 30, are a plurality of bristles 42. These bristles may be shaped however desired by the user or manufacturer and are not intended to be limited to the gently sloping embodiment shown in the figures. For instance, the brush shape could be rectangular, circular, triangular, etc. Any number rows of bristles may be used, or a single stand of bristles may be present. These bristles may comprise animal hair, synthetic materials, or even stiff a metal. Alternatively, the wiping attachment 40 may comprise a putter brush 43 comprising a cloth or chamois for wiping dew and grass off a putter face, as shown in FIG. 17. A variety of interchangeable wiping attachment/elements can be provided for different uses and conditions.

Figure 12:
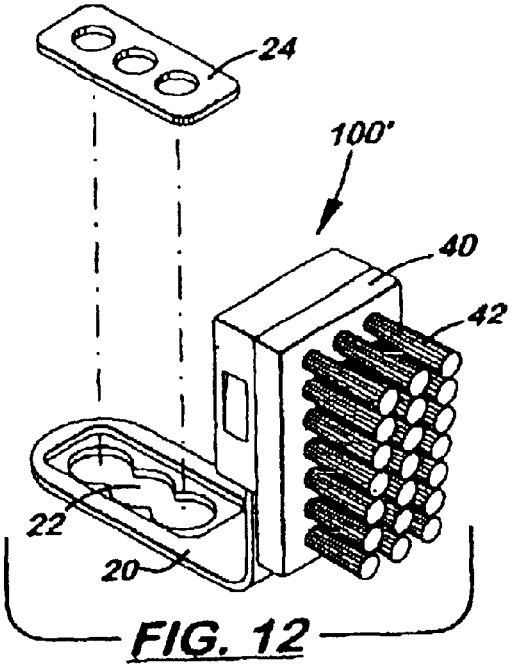
FIG. 12 is a perspective view of a fifth embodiment of the present invention.
Figure 13:
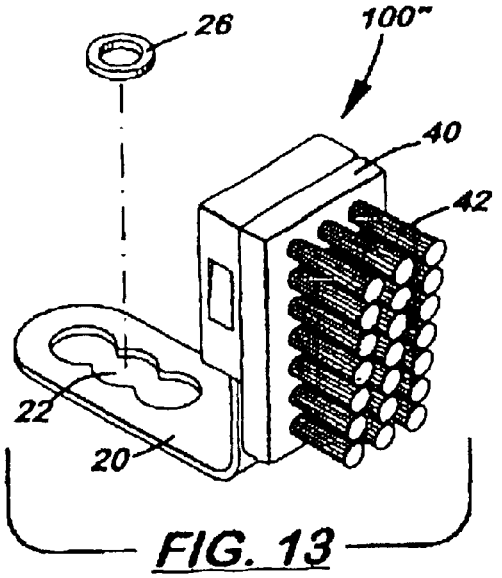
FIG. 13 is a perspective view of a sixth embodiment of the present invention.

Referring now to FIG. 12, shown is an alternate embodiment of a golf shoe brush attachment 100', this embodiment showing the ability to use a spacer insert 24 within the first flange 20. This insert able to be inserted into a trough inlaid within the first flange 20. Utilization of such an insert would be useful where the golf shoe spike stud utilized has a much narrower diameter whereby necessitating the need for smaller diameter orifices 22'. Utilization of such an insert would allow for greater interchangeability between the present invention and various makes, models and styles of golf shoes. This can be further seen in the embodiment shown in FIG. 13, which would utilize a spacer ring 26 rather than the spacer 24 shown in FIG. 12. This spacer ring 26 having an outside diameter slightly smaller than the orifice 22 into which it is set.

Use of such inserts and the like allow the present invention to be adjustable two ways. First, allowing the present invention to be usable with various different styles of shoes and therefore spike varieties and spike post sizes. Second, the present invention would be adjustable with regard to the distance between the spike and the vertical turn (the junction between the first flange and the second flange). This is particularly useful because the spikes on the heel of a golf shoe are typically closer to the outside edge of the sole than the spikes on the toe/ball portion of the golf shoe. Thus, the golfer would be able to purchase one device able to be utilized on both the heel spikes and the toe/ball portion spikes.

Additionally, the first flange could be configured similar to the shape of a nutcracker in that it would have a hinge that would allow the first flange to flex laterally to separate and fit around the spike post while it was partially unscrewed from the spike hole. In such a manner, the first flange could be bent, flexed or stretched over the spike and then released, thereby engaging the spike appropriately without necessitating the removal of the spike from the sole.

Figure 14:
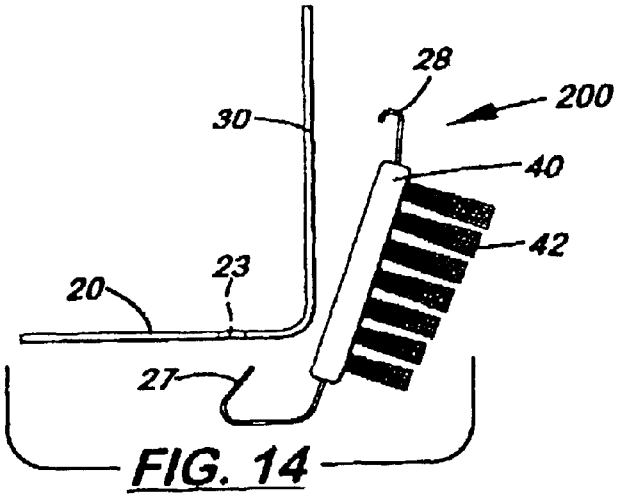
FIG. 14 is a side, environmental view of a seventh embodiment of the present invention.
Figure 15:
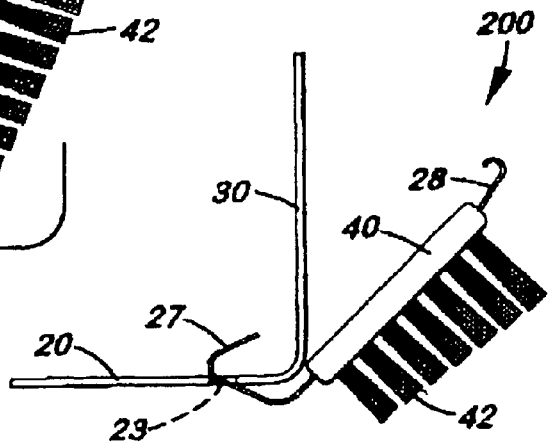
FIG. 15 is a second side sequential view of the embodiment shown in FIG. 14.
Figure 16:
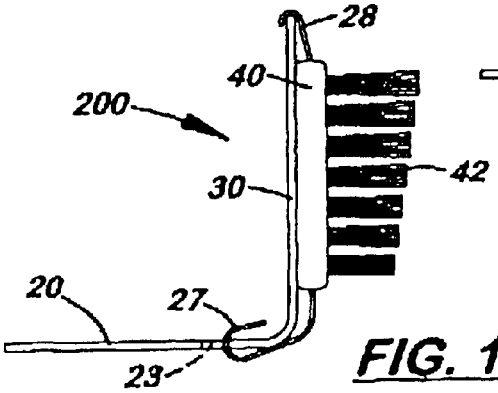
FIG. 16 is a third side sequential view of the embodiment shown in FIG. 14.

Referring now to FIGS. 14 through 16, shown is an alternate embodiment of the present invention. In this embodiment, the golf shoe brush attachment 200 comprises a wiping element 40 having extending therefrom a pair of flanges or tabs 27, 28 wherein the flanges or tabs could cooperate with the first flange 20 and/or the second flange 30 for locking the wiping element 40 upon the second flange 30. In the embodiment shown, the tab 27 is able to be inserted through an orifice 23 defined within the first flange 20 and the second tab 28 is able to resiliently be flexed in order to snap over the top portion of the second flange thereby locking the wiping element having bristles 42 upon the second flange 30.

Figure 18:
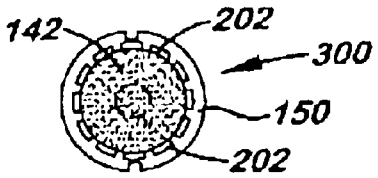
FIG. 18 is a top view of a ninth embodiment of the present invention.
Figure 19:
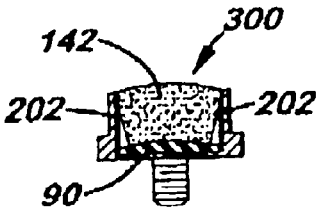
FIG. 19 is a cross-sectional side view of the embodiment of FIG. 18.
Figure 20:
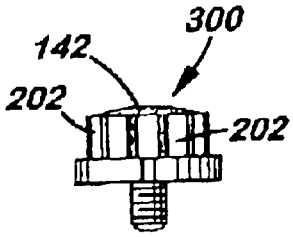
FIG. 20 is a side view of the embodiment of FIG. 18.

Referring now to FIG. 18, shown is an alternative embodiment of the present invention. In this embodiment, the attachment 300 could also be used in conjunction with spikes 202 or the spikes 202 could be used in conjunction with the attachment 300. In such an arrangement, the bristles 142 would be placed in the middle of the existing spike teeth 202. The bristles 142 which are softer than the spike teeth 202 would then fold or collapse allowing the spikes 202 to enter the turf. The spike 202 could also be developed so that the brush would actually collapse into a recessed pocket 90 when a certain amount of force is applied. This recessed pocket could also be filled with a compressible material, such as a foam, a spring, etc. The brush 202 could not collapse into the pocket 90 at the presence of any force or it would not work when a clubface was rubbed against it for the purpose of cleaning.

Figure 21:
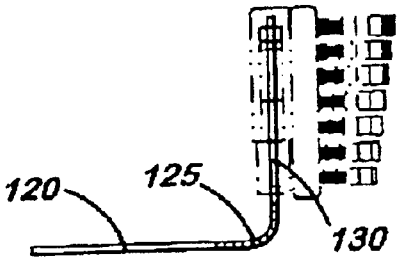
FIG. 21 is a side view of a tenth embodiment of the present invention.
Figure 22:
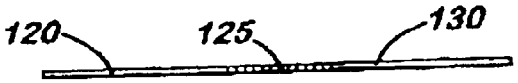
FIG. 22 is a partial side view of the embodiment of FIG. 21.
Figure 23:
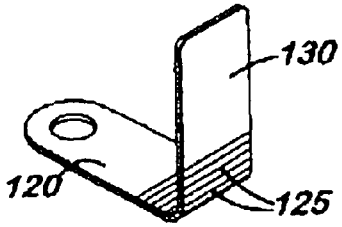
FIG. 23 is a partial perspective view of the embodiment of FIG. 21.

Referring now to FIGS. 21–23, shown in an alternative embodiment for the first and second flanges 120, 130. In this embodiment, the flanges would be made of a malleable or adjustable material that could be curved to fit different shoes. Creases 125 or other means for aiding in regular curving may also be provided. Additionally, the flanges themselves could have a spike post attached to it and be screwed into the spike hole with and then bent up and around the sole to a vertical position to accept the brush attachment. Such a flange would preferably also have a number of spikes extending downwards therefrom to compensate of the spike removed. The adjustment insert could also potentially be replaced by spike holes that were self adjusting. This may be accomplished by having a forming material that would fit around any spike.

Figure 24:
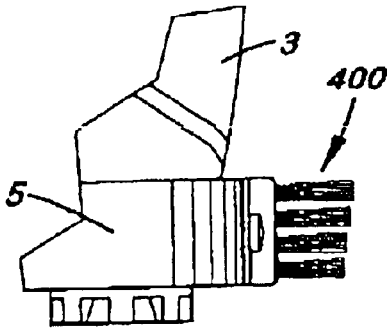
FIG. 24 is an environmental side view of an eleventh embodiment of the present invention.
Figure 25:
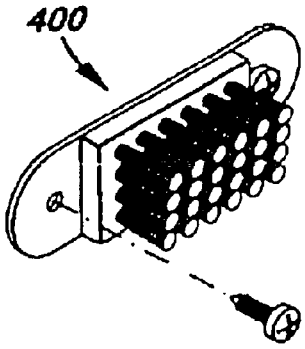
FIG. 25 is an exploded perspective view of the embodiment of FIG. 24.

Referring now to FIG. 24, shown is another embodiment of the present invention. In this embodiment, the attachment

400 could also be adapted to have the brush portion able to be affixed to the heel 5 of the golf shoe 3 using screws or an adhesive.

Although not shown in the figures, it is expressly understood that the utilization of the present invention with the side embodiments may require the provision of a replacement spike having a longer than average spike post. This longer spike post may be necessary to compensate for the thickness of the first flange. Additionally, such a spike could be designed with a lower profile, thereby compensating for the addition of the first flange which would reside between the spike and the sole.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

I claim:

1. A golf shoe brush attachment adapted to be attached to a golf shoe for cleaning golf club heads, said golf shoe having a side wall, said brush attachment comprising:

a generally L-shaped bracket having a first flange generally perpendicular to a second flange, said first flange formed with at least one orifice defined therein able to receive and to engage a single spike projecting from an underside of said golf shoe, said second flange having an inner side opposite an outer side, said inner side facing and generally perpendicular to said golf shoe side wall when said first flange is frictionally held by said spike;

a wiping element for wiping a golf club head; and a connection for connecting said wiping element to said second flange, wherein said connection is releasable, thereby allowing said wiping element to be detached from said second flange, said wiping element extending from said golf shoe generally perpendicular to and away from said outer side of said second flange, said wiping element being operative to clean a golf club head by a sweeping movement of said golf club head against the same.

2. The brush attachment of claim 1, wherein said wiping element is a brush.

3. The brush attachment of claim 1, wherein said wiping element is a chamois.

4. The brush attachment of claim 1 comprising a plurality of overlapping orifices thereby allowing said second flange to be spaced a desired distance from said golf shoe side wall.

5. A golf shoe brush attachment adapted to be attached to a golf shoe brush cleaning golf club heads, said golf shoe having a side wall, said brush attachment comprising:

a generally L-shaped bracket having a first flange generally perpendicular to a second flange, said first flange formed with at least one orifice defined therein able to receive and to be frictionally held by a single spike projecting from an underside of said golfer's shoe, said second flange having an inner side opposite an outer side, said inner side facing and generally perpendicular to said goifer's shoe side wall when said first flange is frictionally held by said spike;

a wiping element for wiping a golf club head, said wiping element comprising a number of bristles; and a connection for connecting maid wiping element to said second flange, wherein said connection for connecting is releasable, thereby allowing said wiping element to be detached from said second flange, said wiping element extending from said golf shoe generally perpendicular to and away from said outer side of said second flange, said wiping element being operative to clean a golf club head by a sweeping movement of said golf club head against the same.

6. The brush attachment of claim 5 comprising a plurality of overlapping orifices thereby allowing said second flange to be spaced a desired distance from said golf shoe side wall.

7. A golf shoe brush attachment adapted to be attached to a golf shoe for cleaning golf club heads, said golf shoe having a side wall, said attachment comprising:

a generally L-shaped bracket having a first flange generally perpendicular to a second flange, said first flange formed with at least one orifice defined therein able to receive and to be frictionally held by a single spike projecting from an underside of said golf shoe, said second flange having an inner side opposite an outer side, said inner side facing and generally perpendicular to said golf shoe side wall when said first flange is frictionally held by said spike;

a wiping element for wiping a golf club head, said wiping element comprising a number of bristles; and a connection for connecting said wiping element to said second flange, said wiping element extending from said golf shoe generally perpendicular to and away from said outer side of said second flange, said wiping element being operative to clean a golf club head by a sweeping movement of said golf club head against the same, wherein said connection for connecting is releasable, thereby allowing said wiping element to be detached from said second flange.

8. The brush attachment of claim 7 comprising a plurality of overlapping orifices thereby allowing said second flange to be spaced a desired distance from said golf shoe side wall.

9. A golf shoe brush attachment adapted to be attached to a golf shoe for cleaning golf club heads, said golf shoe having a side wall, said brush attachment comprising:

a generally L-shapad bracket having a first flange generally perpendicular to a second flange, said first flange formed with a plurality of overlapping orifices defined therein, said plurality of orifices each able to receive and to engages single spike projecting from an underside of said golf shoe thereby allowing said second flange to be spaced a desired distance from said golf shoe side wall, said second flange having an inner side opposite an outer side, said inner side facing and generally perpendicular to said golfer's shoe side wall when said first flange is frictionally held by said spike;

a wiping element for wiping a golf club head, said wiping element comprising a number of bristles; and a connection for connecting said wiping element to said second flange, said wiping element extending from said golf shoe generally perpendicular to and away from said outer side of said second flange, said wiping element being operative to clean a golf club head by a sweeping movement of said golf club head against the same.

10. A golf shoe brush attachment adapted to be attached to a golf shoe for cleaning golf club heads, said golf shoe having a side wall, said brush attachment comprising:

a generally L-shaped bracket having a first flange generally perpendicular to a second flange, said first flange formed with at least one orifice defined therein able to receive and to engage a single spike projecting from an underside of said golf shoe, said second flange having an inner side opposite an outer side, said inner side facing and generally perpendicular to said golf shoe side wall when said first flange is frictionally held by said spike;

a wiping element for wiping a golf club head, wherein said wiping element is a chamois; and a connection for connecting said wiping element to said second flange, said wiping element extending from said golf shoe generally perpendicular to and away from said outer side of said second flange, said wiping element being operative to clean a golf club head by a sweeping movement of said golf club head against the same.

11. A golf shoe brush attachment adapted to be attached to a golf shoe for cleaning golf club heads, said golf shoe having a side wall, said brush attachment comprising:

a generally L-shaped bracket having a first flange generally perpendicular to a second flange, said first flange formed with a plurality of overlapping orifices defined therein, said plurality of orifices each able to receive and to engage a single spike projecting from an underside of said golf shoe thereby allowing said second flange to be spaced a desired distance from said golf shoe side wall, said second flange having an inner side opposite an outer side, said inner side facing and generally perpendicular to said golf shoe side wall when said first flange is frictionally held by said spike;

a wiping element for wiping a golf club head; and a connection for connecting said wiping element to said second flange, said wiping element extending from said golf shoe generally perpendicular to and away from said outer side of said second flange, said wiping element being operative to clean a golf club head by a sweeping movement of said golf club head against the same.

* * * * *